US005601462A

United States Patent [19]

Harlow

[11] Patent Number: 5,601,462

[45] Date of Patent: Feb. 11, 1997

[54] TOY BOAT

[76] Inventor: Onnie Harlow, 603 W. Shawnee, Tahlequah, Okla. 74464

[21] Appl. No.: 636,049

[22] Filed: Apr. 22, 1996

[51] Int. Cl.[6] ..... B60L 11/02

[52] U.S. Cl. ..... 440/6; 440/38; 114/270

[58] Field of Search ..... 114/270, 271, 114/363, 272, 274, 123, 162; 441/65, 129, 130; 440/6, 38; 446/153, 160–165

[56] References Cited

U.S. PATENT DOCUMENTS

| | | | |
|---|---|---|---|
| 1,685,350 | 9/1928 | Buchet . | |
| 3,426,724 | 2/1969 | Jacobson | 114/270 |
| 3,442,246 | 5/1969 | Paolone | 114/270 |
| 3,447,259 | 6/1969 | Cagen . | |
| 3,528,195 | 9/1970 | Cooper . | |
| 3,570,444 | 3/1971 | Farr | 114/270 |
| 3,791,335 | 2/1974 | Del Vecchio | 114/270 |
| 3,824,735 | 7/1974 | Brandstatter | 46/243 |
| 4,269,135 | 5/1981 | Labonia | 114/272 |
| 4,311,108 | 1/1982 | Horton | 114/61 |
| 5,014,639 | 5/1991 | Day | 114/270 |

*Primary Examiner*—Stephen Avila
*Attorney, Agent, or Firm*—Robert K. Rhea

[57] ABSTRACT

A child supporting toy boat is formed by an airplane type hull forming fuselage having laterally projecting wings terminating in a pair of ovate pods adding buoyancy to the craft. A bulkhead divides the fuselage to form a forward closed motor and battery containing compartment and a cylindrical rearwardly open end portion supplied with water through wall opening rearwardly of the bulkhead. A motor driven shaft extending rearwardly through the bulkhead drives a propeller in the cylindrical end portion and propels the craft in response to a control shaft projecting upwardly through the fuselage and operated by a child seated on the fuselage.

12 Claims, 2 Drawing Sheets

TOY BOAT

BACKGROUND OF THE INVENTION

This invention relates to toy boats and more particularly to a battery powered boat having an airplane configuration.

1. Field of the Invention

The economic and play value of a toy boat is related, to a great extent at least, to how closely it relates to a known craft, whether it be a boat or other well known configuration, and to the mode of operation. This toy boat departs from the known generally conventional boat shape, whether it be of the row boat configuration or speed boat, by simulating an airplane in general appearance.

To achieve a desirable appearance for the toy boat, considerable effort is made toward faithfully following the general pattern of a known craft, and to provide for automatic operation of the boat, as for example by a battery powered motor. Further, an aircraft type of design for a toy boat adds to its stability so that it is not easily tipped over. It is further desirable to provide a boat of simplified construction and mode of operation which may be economically produced in quantity.

2. Description of the Prior Art

U.S. Pat. No. 1,685,350 issued Sep. 25, 1928 to Buchet for TOY SPEED BOAT, and U.S. Pat. No. 3,447,259 issued Jun. 3, 1969 to Ideal Toy Corporation for TOY BOAT each disclose a generally row boat configuration having an inboard electric motor powering a propeller disposed downwardly and rearwardly of the boat bottom by a shaft extending through the boat bottom.

U.S. Pat. No. 3,528,195 issued Sep. 15, 1970 to Ideal Toy Corporation for TOY BOAT AND SIMULATED ELECTRIC OUTBOARD MOTOR similarly discloses a generally row boat configuration having an outboard motor hingedly mounted on its transom in a manner substantially common with outboard motors on boats.

U.S. Pat. No. 3,824,735 issued Jul. 23, 1974 to Brandstatter for TOY BOAT WITH SEPARATE COMPARTMENT FOR BATTERY AND MOTOR, and U.S. Pat. No. 4,311,108 issued Jan. 19, 1992 to Horton for PROPELLED WATER CRAFT are believed good examples of the further state-of-the art.

The Brandstatter patent features a separate compartment or opening in the boat hull base between lateral side portions of its rearward end portion which supports a motor and propeller projecting toward the bow end of the craft.

The Horton patent features a pair of pontoons supporting a generally flat deck forming a hull, having a pair of battery powered electric motors disposed at the rearward end of the respective pontoons powering propellers for propulsion.

This invention is believed distinctive over all of the above named patents by providing a tube-like generally hollow hull having laterally projecting aircraft-type wings terminating in pontoon type hollow ovate pods which adds to the buoyancy of the craft. Further, an inboard motor driving a propeller within the rearward end portion of the hull draws the water into the hull through lateral hull openings and discharges it through the rearward tubular end of the hull in a jet-like action for propelling the craft.

SUMMARY OF THE INVENTION

A boat hull is formed by an elongated hollow tubular body having its outer surface converging forwardly to define a closed end and a rearward cylindrical open end. A pair of aircraft-like wings project laterally from respective sides of the hull substantially medially its ends and terminate in a hollow generally ovate shaped pod having its major axis parallel with the longitudinal axis of the hull.

The interior of the hull is transversely divided by a bulkhead to form a forward battery and motor containing compartment and a rearwardly open compartment receiving water through perforations in its outer wall. A propeller in the rearward compartment is driven by the motor angularly rotating a shaft extending through the bulkhead and controlled by the operator seated on the top of the hull. A direction control rudder depending from the hull is controlled the operator moving a control shaft.

The principal object of this invention to form an aircraft-type toy boat having a closed hull and lateral wings in which the hull contains an onboard motor and propeller exhausting water through the rearward open end of the hull in a forward boat propelling action, and to provide an operator seat on the hull adjacent an upstanding rudder control shaft.

DESCRIPTION OF THE PREFERRED EMBODIMENT

Figure 1:
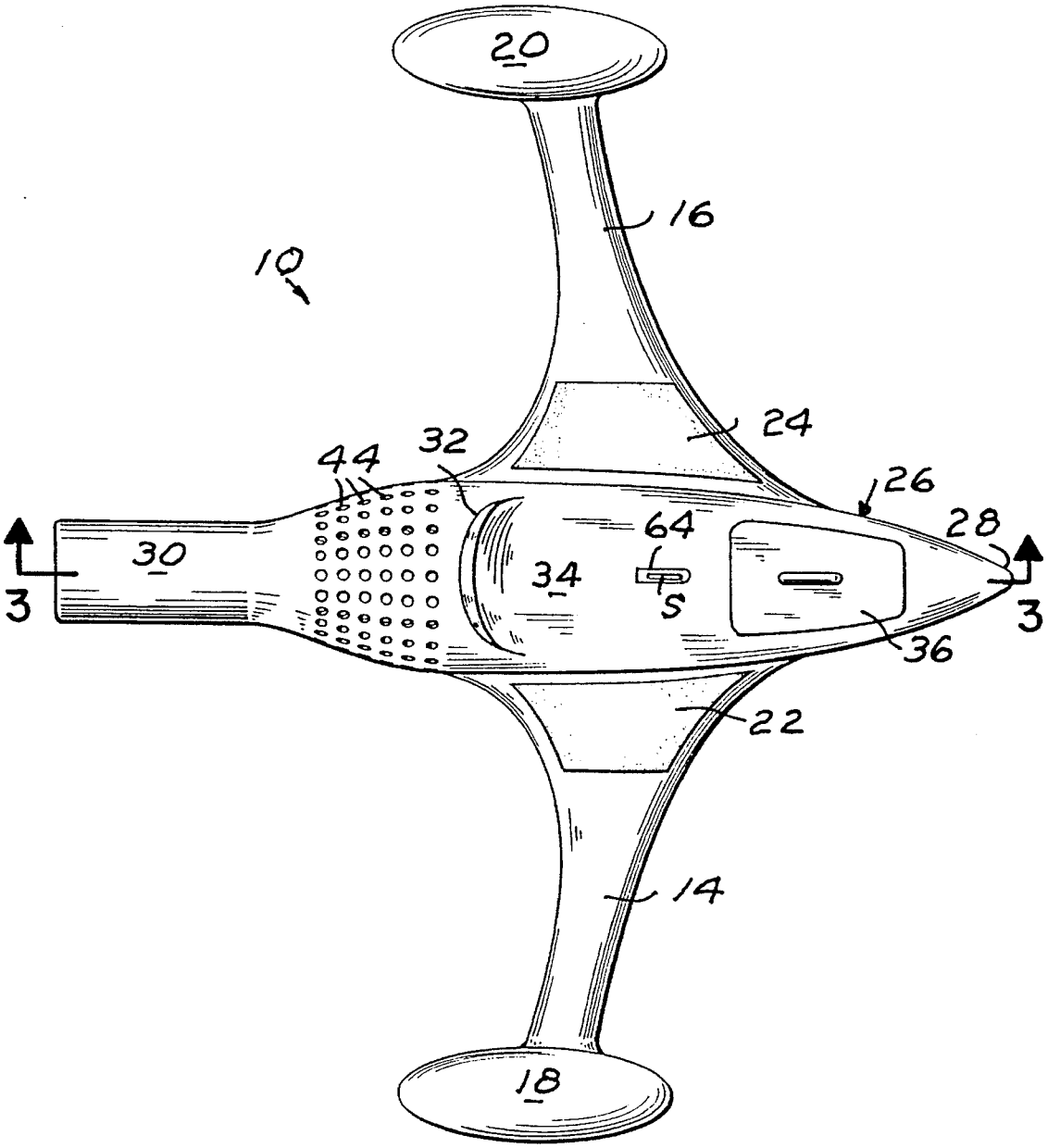
FIG. 1 is a top view.
Figure 2:
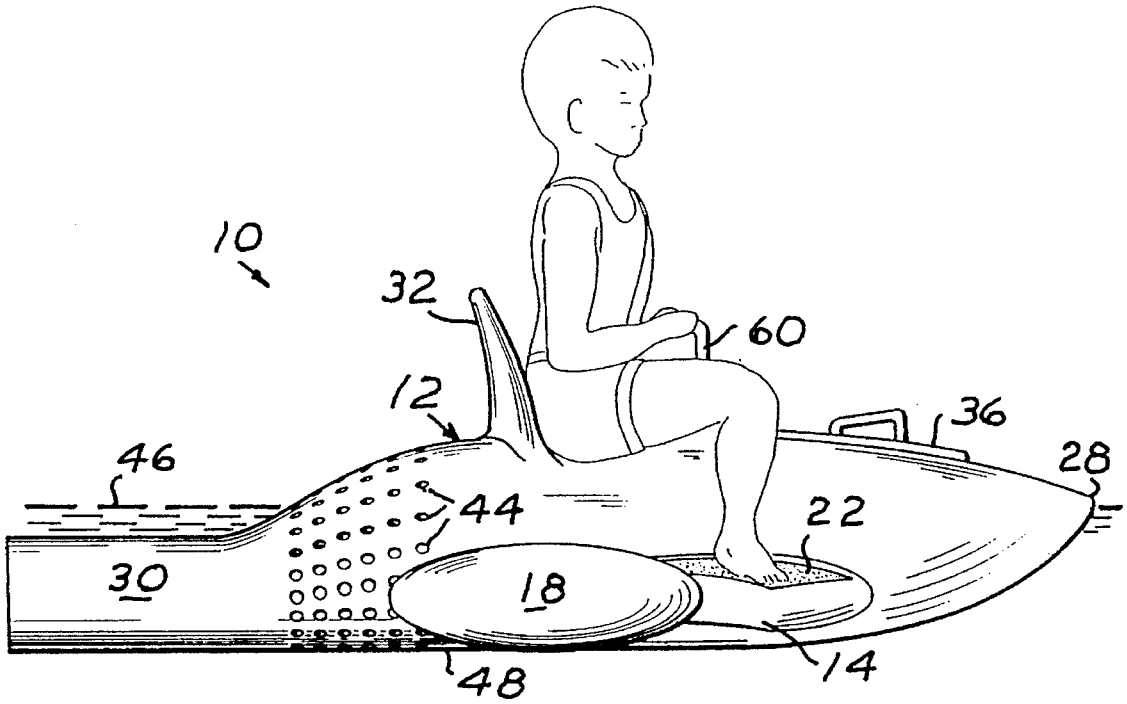
FIG. 2 is a left side elevational view of FIG. 1.
Figure 3:
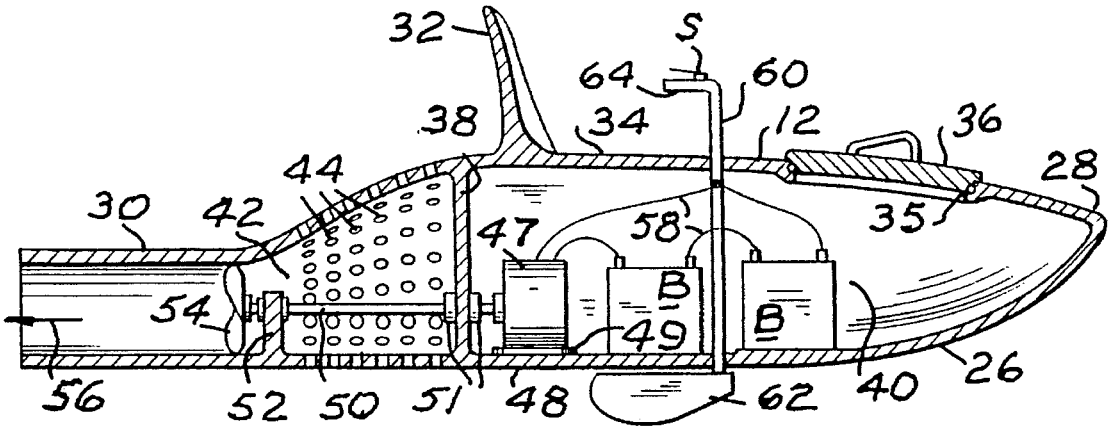
FIG. 3 is a vertical cross sectional view taken substantially along the line 3—3 of FIG. 1.

Like characters of reference designate like parts in those figures of the drawings in which they occur.

In the drawings:

The reference numeral 10 indicates the toy boat as a whole which is generally aircraft shaped in top view. The boat 10 comprises an elongated tube-like fuselage or hull 12 provided with laterally projecting wings 14 and 16 terminating in ovate shaped hollow pods 18 and 20 respectively providing stability for the hull when in water.

The upper surface of the wings adjacent the hull 12 form a pair of foot pads or foot rests 22 and 24 respectively. The surface of the forward end portion 26 converges forwardly from the wings to form a hull closed end 28. The rearward open end portion of the hull defines a cylindrical portion 30 for the purposes presently explained.

Substantially medially its ends, the hull supports an upstanding seat back 32 defining a seating area 34 ion the upper surface of the hull adjacent and forwardly of the seat back 32. Forwardly of the seat portion 34 the hull is provided with an opening 35 closed by a lid 36.

The interior of the hull is transversely divided by a bulkhead 38 rearwardly of the vertical plane defined by the seat back 32 to form a hull motor and battery forward compartment 40 and a rearward compartment 42. Between the forward limit of the hull cylindrical portion 30 and the bulkhead 38, the wall of the hull is provided with a series of longitudinally and transversely aligned rows of openings or apertures 44 for admitting water 46 into the rearward compartment 42 for the purposes presently explained.

An electric motor 47 is mounted in the forward compartment 40 adjacent the forward limit of the bulkhead 38 on a base 49 on the inner surface of the hull bottom 48 the drive shaft of the motor 47 is axially connected with a drive shaft 50 supported at its respective end portions by waterproof bearings and shaft surrounding packing glands 51 on the bulkhead 38 and a propeller stand 52 rearwardly of bulkhead and the downstream position of the apertures 44. A propeller 54 is axially connected with the shaft 50 and angularly rotated by the motor 47 for exhausting water from the compartment 40 through the cylindrical portion 30 in the direction of the arrow 56.

One or more batteries B are supported by the hull in its forward compartment 40 and operatively connected with the motor 47 by wires 58. A rudder shaft 60 having a rudder 62 on its depending end projects vertically through the hull forwardly of the seat 34 and includes a handle 64 at its upper limit moved by an operator for guiding the boat 10. A switch S supported by the rudder shaft handle is interposed in the wiring 58 for energizing the motor 47.

Obviously the invention is susceptible to changes or alterations without defeating its practicability. Therefore, I do not wish to be confined to the preferred embodiment shown in the drawings and described herein.

I claim:

1. A toy boat, comprising;

an elongated tubular hull having a forward closed end and a rearward cylindrical water containing open end portion and having an aircraft type horizontal wing cooperatively projecting laterally from opposite sides of the hull intermediate its ends;

a hollow ovate pod secured to each said wing opposite said hull and having its major axis parallel with the longitudinal axis of said hull;

a bulkhead dividing said hull to form a forward motor compartment, said hull having water admitting openings rearwardly of said bulkhead;

a battery and a battery operated motor in said motor compartment;

a propeller in said cylinder portion opposite its open end;

drive shaft means operatively connecting said motor with said propeller for forcing water through the cylindrical rearward open end portion and propelling said boat forwardly; and, boat control means including a rudder and wiring means connecting said battery with said motor.

2. The toy boat according to claim 1 and further including: p1 an operator's seat including a seat back on said hull intermediate its ends.

3. The toy boat according to claim 2 in which said control means further includes:

a rudder control shaft disposed forwardly of said seat and connected with said rudder.

4. The toy boat according to claim 3 in which the wiring means further includes a motor control switch mounted on said control shaft.

5. The toy boat according to claim 4 in which the drive shaft means further includes:

a propeller support interposed between the propeller and said bulkhead; and, bearings journaling said shaft.

6. The toy boat according to claim 5 and further including:

water excluding packing gland means surrounding said drive shaft means adjacent one side of said bulkhead.

7. A toy boat, comprising;

an elongated tubular hull having a bottom wall and having an outer forwardly converging wall forming a forward closed end and having a rearward cylindrical water containing open end portion and having an aircraft type horizontal wing cooperatively projecting laterally from opposite sides of the hull adjacent the plane of the bottom wall intermediate its ends for forming a foot rest adjacent respective sides of the hull;

an ovate pod secured to each said wing opposite said hull and having its major axis parallel with the longitudinal axis of said hull;

a bulkhead dividing said hull to form a forward motor compartment, said hull having water admitting openings rearwardly of said bulkhead;

a battery and a battery operated motor in said motor compartment;

a propeller in said cylinder portion opposite its open end;

drive shaft means operatively connecting said motor with said propeller for forcing water through the cylindrical rearward open end portion and propelling said boat forwardly; and, boat control means including a rudder and wiring means connecting said battery with said motor.

8. The toy boat according to claim 7 and further including:

an operator's seat including an upstanding seat back on said hull forwardly of said bulkhead.

9. The toy boat according to claim 8 in which said control means further includes:

a rudder control shaft vertically projecting through said hull forwardly of said seat and connected with said rudder.

10. The toy boat according to claim 9 in which the wiring means further includes a motor control switch mounted on said control shaft.

11. The toy boat according to claim 10 in which the drive shaft means further includes:

a propeller support interposed between the propeller and said bulkhead; and, bearings journalling said shaft.

12. The toy boat according to claim 11 and further including:

water excluding packing gland means surrounding said drive shaft means adjacent one side of said bulkhead.

* * * * *